US006880277B2

(12) United States Patent
Kaminski

(10) Patent No.: US 6,880,277 B2
(45) Date of Patent: Apr. 19, 2005

(54) PLURAL-PART EVIDENCE MARKER

(76) Inventor: Jane A. Kaminski, 13204 E. Outer Dr., Detroit, MI (US) 48224

( * ) Notice: Subject to any disclaimer, the term of this patent is extended or adjusted under 35 U.S.C. 154(b) by 119 days.

(21) Appl. No.: 10/207,861

(22) Filed: Jul. 31, 2002

(65) Prior Publication Data

US 2004/0020089 A1 Feb. 5, 2004

(51) Int. Cl.[7] ..... G09F 7/00
(52) U.S. Cl. ..... 40/584; 40/607.02; 40/611.01
(58) Field of Search ..... 40/124.01, 584, 40/606.14, 607.02, 611.01, 124.4; 116/209; 33/474, 476, 494

(56) References Cited

U.S. PATENT DOCUMENTS

| | | | | |
|---|---|---|---|---|
| 4,291,882 A | * | 9/1981 | Del Monte | 273/148 A |
| D265,346 S | | 7/1982 | Maier | |
| 4,385,459 A | * | 5/1983 | McGrath et al. | 40/730 |
| D339,186 S | | 9/1993 | Vandergriff et al. | |
| 5,379,106 A | | 1/1995 | Baldur | |
| D359,699 S | | 6/1995 | Vandergriff et al. | |
| 5,633,717 A | | 5/1997 | Baldur | |
| 5,787,616 A | | 8/1998 | Rogers | |
| 5,915,852 A | | 6/1999 | Rogers | |
| 6,243,958 B1 | * | 6/2001 | Ringley, Jr. | 33/474 |
| 6,618,969 B1 | * | 9/2003 | Rogers et al. | 40/124.16 |

OTHER PUBLICATIONS

Kaminski, Jane A., "A New Dimension in Forensics," Proceedings of the American Academy of Forensic Sciences, 1999 (McCormick–Armstrong, Colorado Springs, CO), p. 123 (8 pgs.).

Lynn Peavey Company, "Should we develop this new idea?", The Daily Hound , Jun., 1997 (Lynn Peavey Company, Lenexa, KS), p. 5 (8 pages.).

* cited by examiner

*Primary Examiner*—Brian K. Green
(74) *Attorney, Agent, or Firm*—Cass L. Singer

(57) ABSTRACT

An evidence marker 10 includes at least two flat marker elements 20 bearing visual indicia thereon, and a substantially rigid leg unit 30 connecting and detachably securing the at least two flat marker elements at an angle (preferably 90°) with respect to one another. Each of the flat marker elements is preferably L-shaped and symmetrical, and more preferably about 1 mm thick and having a pair of perpendicular outer edges 22 about 10 to 11 cm long. The leg unit consists of six identical, orthogonally disposed legs 32 substantially shorter than the pair of edges 22 of the flat marker elements. The six legs 32 of the leg unit 30 are preferably about 1 to 3 cm and about 1.5 cm thick. Each of the six legs of the leg unit preferably has four orthogonal grooves 34 formed longitudinally therein. Each groove 34 is capable of receiving an edge of one of the flat marker elements therein, retaining one of the flat marker elements therein by friction.

19 Claims, 3 Drawing Sheets

PLURAL-PART EVIDENCE MARKER

TECHNICAL FIELD

This invention relates generally to forensics. More particularly, this invention relates to evidence markers, that is, to devices which assist in memorializing (making a permanent record of) and quantitatively characterizing (permitting calculation or measurement of quantities related to) visible evidence, for example, evidence present at a crime scene.

BACKGROUND OF THE INVENTION

Crime is a problem which to one degree or another has always been part of human society. It is believed that certainty in arrest, conviction and punishment is a significant deterrent to crime. In U.S. courts, convictions for crimes are based on evidence. It is highly desirable that any evidence presented be reliable. Reliable evidence not only makes it more likely that a particular person accused of a crime will in fact be convicted of a criminal offense, reliable evidence makes it more likely that the accused is in fact the person who actually committed a particular offense.

A variety of visual markers for evidence viewed at a crime scene are well known. Such evidence markers are typically positioned adjacent to an item of evidence at the scene (such as a stain, a spot, an article, a portion of a corpus delicti or the like), and the marker photographed with the item of evidence to provide a memorial of the evidence. The memorial can then be relied upon during trial as an aid in reliably establishing one element or another of the criminal offense which was committed. Evidence markers often bear visual indicia on them which permit the item of evidence to be characterized by one or more pertinent quantities, for example, its height and width.

Prior evidence markers have been subject to certain drawbacks during use. Evidence markers are known which are generally flat in physical configuration, for example, a simple ruler. Unfortunately, the item of evidence under consideration may not be similarly flat. In such a case it may possible to challenge at trial the admission of a photograph showing the item of evidence and the marker. The challenge would be made on the basis that changes in perspective, as a result of the angle from which the photograph was taken, cause the photograph to fail to represent the item of evidence accurately. Specifically, camera angle may shorten or lengthen perspective and make the item of evidence appear unduly large or small with respect to the marker.

An evidence marker such as the ABFO No. 2 Scale (shown in FIG. 1 and available as Catalog No. 6-3875 from Lightning Powder Co., Inc., 1230 Hoyt St., SE, Salem, Oreg. 97302) may obviate this drawback to some degree when an item of evidence lies on a flat surface. The relative size of the two arms of the marker, along with testimony that the evidence and marker lay on the same flat surface when photographed, could conclusively establish the angle from which the photograph was taken and thus establish the relation of the marker to the item of evidence. Unfortunately, this cannot be done when the evidence marker and the item of evidence do not lie in the same plane, or when the item of evidence or surface it lies on is not flat. An inability to conclusively establish the size or another characteristic of the item of evidence may permit a successful objection to its introduction at trial, or worse yet, permit a trial verdict to be overturned on appeal.

A partial but incomplete solution was provided in U.S. Pat. No. 5,787,616 (Rogers, Aug. 4, 1998) and No. 5,915, 852 (Rogers, Jun. 29, 1999). The evidence marker disclosed in these patents included a pair of upstanding panels connected to form a free-standing unit, as well as a base panel extending from the lower edge of one of the upstanding panels. The base panel was imprinted with reference indicia such as suitable scales and a photographic target.

While useful for its intended purpose, the evidence marker of these patents failed to fully address the problems mentioned above. For example, the indicia on the marker were provided in only a single plane, that of the base panel. Moreover, the bulk of the marker was several times the size of the scale markings, such that the space needed to store the marker was appreciable, even if plural markers could be stacked on one another.

At page 5 of the June, 1997, issue of "The Daily Hound," a newsletter published by the Lynn Peavey Company, Lenexa, Kans., the instant applicant disclosed a preliminary attempt to display two forensic scales (such as the ABFO No. 2 Scale mentioned above) in a three-dimensional arrangement, much like the shape of a child's jack. The device included a central element connecting the forensic scales, composed of three cocktail straws. Unfortunately, the frailty of this preliminary attempt made it subject to its own practical drawbacks. In the "Proceedings" of the American Academy of Forensic Sciences (Annual Meeting, 1999, the instant applicant described a modification of such a device, in particular, a guide permitting the perpendicular placement of two ABFO No. 2 Scales. The guide was described as similar to a child's jack with an additional "leg." The legs not involved in the stabilization of the scales provided overall support to the device.

It would be highly advantageous to have a device for assisting in memorializing and quantitatively characterizing visible evidence, for example, evidence present at a crime scene, which displayed two or more scale markings or other indicia at a known angle but in different planes, and which could be viewed at the same time, such as to establish a unique photographic angle or direction of view. Knowledge of the lens and film size employed could then be used to establish a specific camera-to-subject distance for evidence which has been photographed. It would also be highly advantageous to have such a device which displayed two or more scale markings or other indicia at a known angle but in different planes, such that the device could be positioned with respect to a non-planar item of evidence so that part of the item of evidence overlapped one scale or another, reliably establishing the size of the item of evidence. The photographic evidence obtained would not be subject to the kinds of challenges which had been successfully raised against photographs using other evidence markers. Finally, it would be highly advantageous to have such a device which was simple and relatively inexpensive in construction, which maintained its scale markings or other visible indicia in a rigid display relationship, yet could be collapsed to a size smaller than that existing while such scale markings or other visible indicia were displayed.

SUMMARY OF THE INVENTION

The foregoing problems are solved and a technical advance is achieved in an illustrative evidence marker for memorializing (making a permanent record of) and quantitatively characterizing (permitting calculation or measurement of quantities related to) evidence viewed at a crime scene. The evidence marker of the present invention comprises at least two flat marker elements bearing visual indicia thereon and having a pair of perpendicular edges, and a substantially rigid leg unit connecting and detachably securing the at least two flat marker elements at an angle with respect to one another. The leg unit consists of six preferably identical and orthogonally disposed legs, each of the six legs being substantially shorter than the edges of the flat marker elements.

In this regard, "substantially shorter" means that each of the six legs is no more than about half as long as the edges of one of the flat marker elements, and preferably no more than about a third as long as the edges of one of the flat marker elements, or preferably no more than about the width of one of the flat marker elements (such width being measured in a direction perpendicular to one of the edges of the element). "Substantially rigid" means that, while the leg unit may possess some modest degree of flexibility, in the absence of an applied force the leg unit is self-sustaining, such that the six legs of the leg unit maintain their orthogonal orientation and keep the flat marker elements disposed at their desired angle while bearing the weight of those marker elements. For example, when the six legs are orthogonally disposed, the marker elements will remain disposed at a right angle relative to one another. Suitable materials for the leg unit include synthetic, plastic, polymeric, metal and rubber materials.

Conveniently, the flat marker elements can be the ABFO No. 2 Scales disclosed above. The ABFO No. 2 Scale is L-shaped and symmetrical, about 1 mm thick and about 1 inch (2.5 cm) wide, and has a pair of perpendicular outer edges about 10 to 11 cm long. When this Scale is used, the six legs of the leg unit are preferably about 1 to 3 cm long, and are preferably square in cross section, about 1.5 cm thick.

Each of the six legs of the leg unit has at least one and preferably four orthogonal grooves formed longitudinally therein. Projections can be provided in the grooves to assist retention of the flat marker elements. Each groove is capable of receiving an edge of one of the flat marker elements therein, and is preferably dimensioned to retain one of the flat marker element therein by friction. Adjacent grooves on each leg communicate so as to allow the corner of the flat marker element (where the perpendicular edges meet) to be fully seated in the leg unit. When the flat marker elements are the ABFO No. 2 Scales disclosed above, each groove is preferably about 1 mm wide and about 5 mm deep.

The evidence marker 10 of the present invention is particularly advantageous in that, by displaying two or more scale markings or other indicia at a known angle but in different planes, a unique photographic angle or direction of view is more readily established than with prior evidence markers. Part of the evidence marker 10 can be overlapped by a non-planar item of evidence, permitting the size of the item of evidence to be more reliably established than with prior evidence markers. The evidence marker 10 is also advantageous in being of relatively simple and inexpensive construction, adequately maintaining the flat marker elements in a substantially rigid relationship while permitting the marker 10 itself to be collapsed to a smaller size for storage (by detaching the marker elements from the leg unit).

In a first aspect, then, the present invention is directed to an evidence marker comprising: at least two flat marker elements bearing visual indicia thereon, each of the flat marker elements having a pair of perpendicular edges; and a substantially rigid leg unit connecting the at least two flat marker elements at an angle with respect to one another; wherein said leg unit consists of six orthogonally disposed legs, each of the legs including at least one groove for receiving an edge of one of the flat marker elements therein; and wherein each of the six legs of the leg unit are substantially shorter than the pair of edges of the flat marker elements.

Preferably, each of the six legs of the leg unit is the same length and has four orthogonal grooves formed longitudinally therein, for receiving an edge of one of the flat marker elements and retaining that element by friction. This results in the flat marker elements being detachable from the leg unit. The leg unit preferably comprises a synthetic, plastic, polymeric, metal or rubber material. Each of the six legs of the leg unit is preferably square in cross-section, more preferably about 1.5 cm thick.

The flat marker elements employed in the present invention are preferably the ABFO No. 2 Scales mentioned above. In such a case, each of the grooves in the six legs of the leg unit is preferably about 1 mm wide and about 5 mm deep. Also in such a case, each of the six legs of the leg unit is about 1 to 3 cm long (measured from the surfaces of the adjacent legs), and more preferably about 2 cm long. The present invention can comprise two, three or more of the flat marker elements.

Although perhaps not preferred, the flat marker elements can instead be permanently secured to the leg unit. Again, although perhaps not preferred, the relative weights of the flat marker elements and the leg unit can be such that the leg unit is capable of resting on three of the six legs of the leg unit (in particular, upon the tips of those three legs) while two or more flat marker elements are connected by the other three legs of the leg unit. Retention of the flat marker elements in the grooves in the legs of the leg unit may be improved by including in each of the six legs one or more projections extending into each groove. Manufacturing considerations may make the inclusion of such projections impractical, however.

In a second aspect, the present invention is directed to a particularly preferred combination of the elements identified above. Thus, in its second aspect, the present invention is directed to an evidence marker comprising: at least two identical flat marker elements bearing visual indicia thereon, each of the flat marker elements being L-shapad and symmetrical, and each being about 1 mm thick and having a pair of perpendicular outer edges about 10 to 11 cm long; and a substantially rigid leg unit connecting and detachably securing the at least two flat marker elements at a right angle with respect to one another, the leg unit comprising a plastic or polymeric material; wherein said leg unit consists of six identical, orthogonally disposed legs about 1 to 3 cm long; wherein the six legs of the leg unit are substantially shorter than the pair of edges of the flat marker elements, are of the same length, are square in cross section and are about 1.5 cm thick; wherein each of the six legs of the leg unit has four orthogonal grooves about 1 mm wide and about 5 mm deep formed longitudinally therein, dimensioned to retain one of the flat marker elements therein by friction.

BRIEF DESCRIPTION OF THE DRAWING

A better understanding of the present invention will now be had upon reference to the following detailed description, when read in conjunction with the accompanying drawing, wherein like reference characters refer to like parts throughout the several views, and in which.

DETAILED DESCRIPTION

Figure 1:
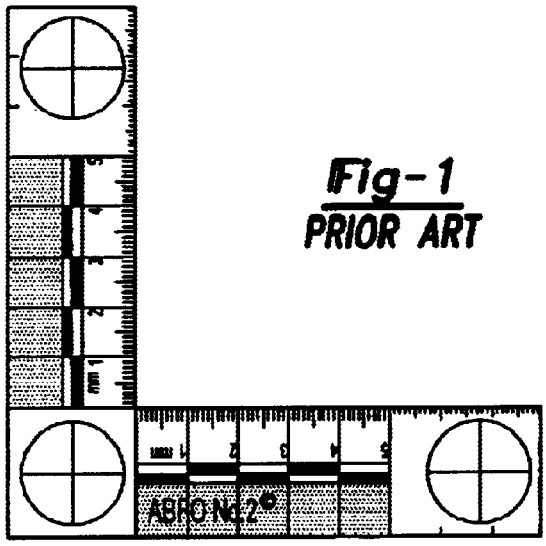
Fig-1 PRIOR ART
FIG. 1 is a top view of a prior art evidence marker, in particular, the ABFO No. 2 Scale mentioned above.
Figure 2:
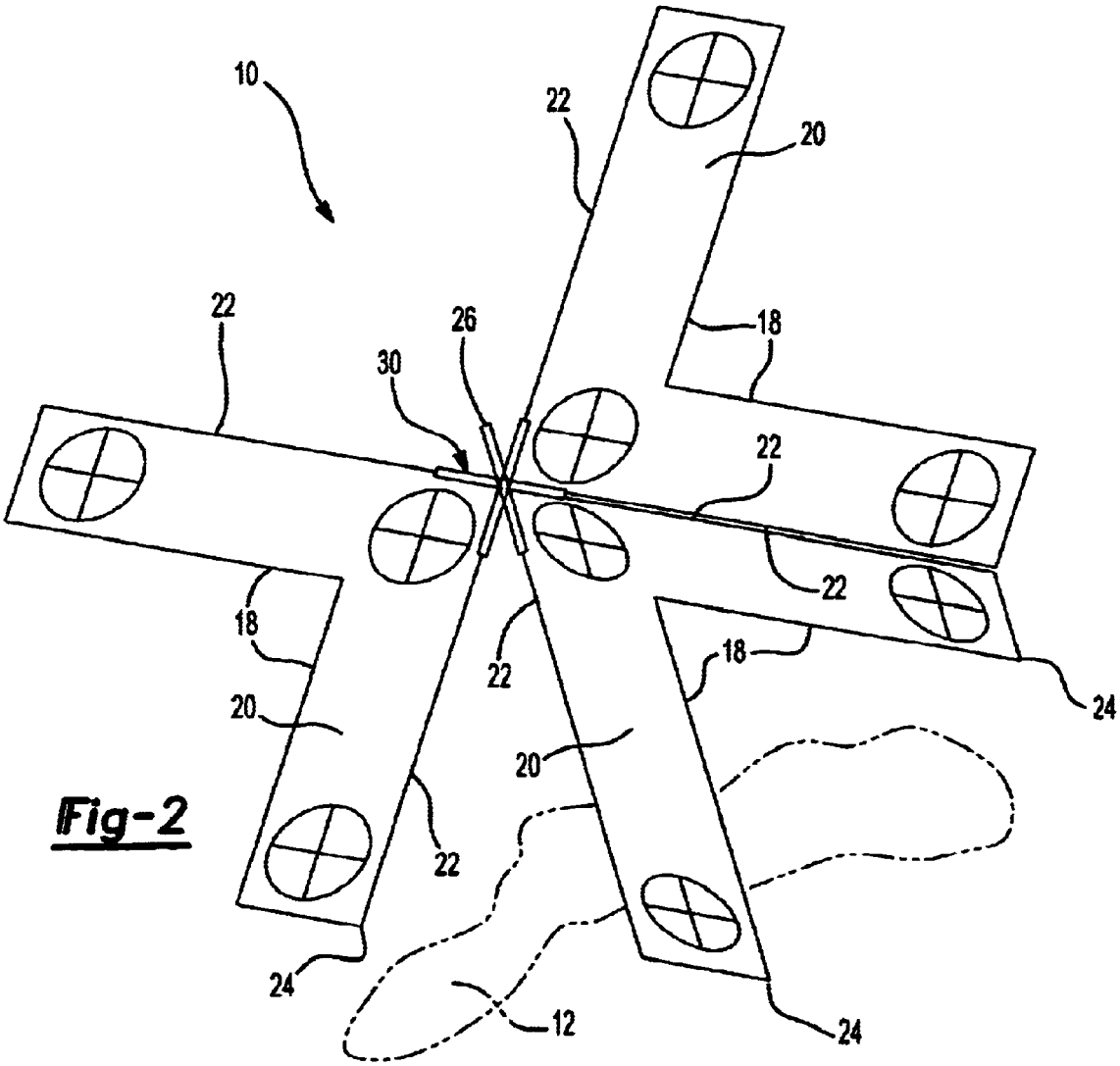
FIG. 2 is a perspective view of the preferred embodiment of the present invention.

With reference first to FIG. 2, the preferred embodiment of an evidence marker 10 according to the present invention is thereshown, useful for memorializing and quantitatively characterizing visible evidence, for example, an item 12 of evidence visible at a crime scene. The evidence marker 10 of the present invention first comprises at least two and preferably three flat market elements 20 bearing visual indicia thereon. The flat marker elements 20 can be the ABFO No. 2 Scales shown in FIG. 1 and thus can L-shaped and symmetrical, each being about 1 mm thick and having a pair of perpendicular outer edges 22 about 10 to 11 cm long.

Figure 3:
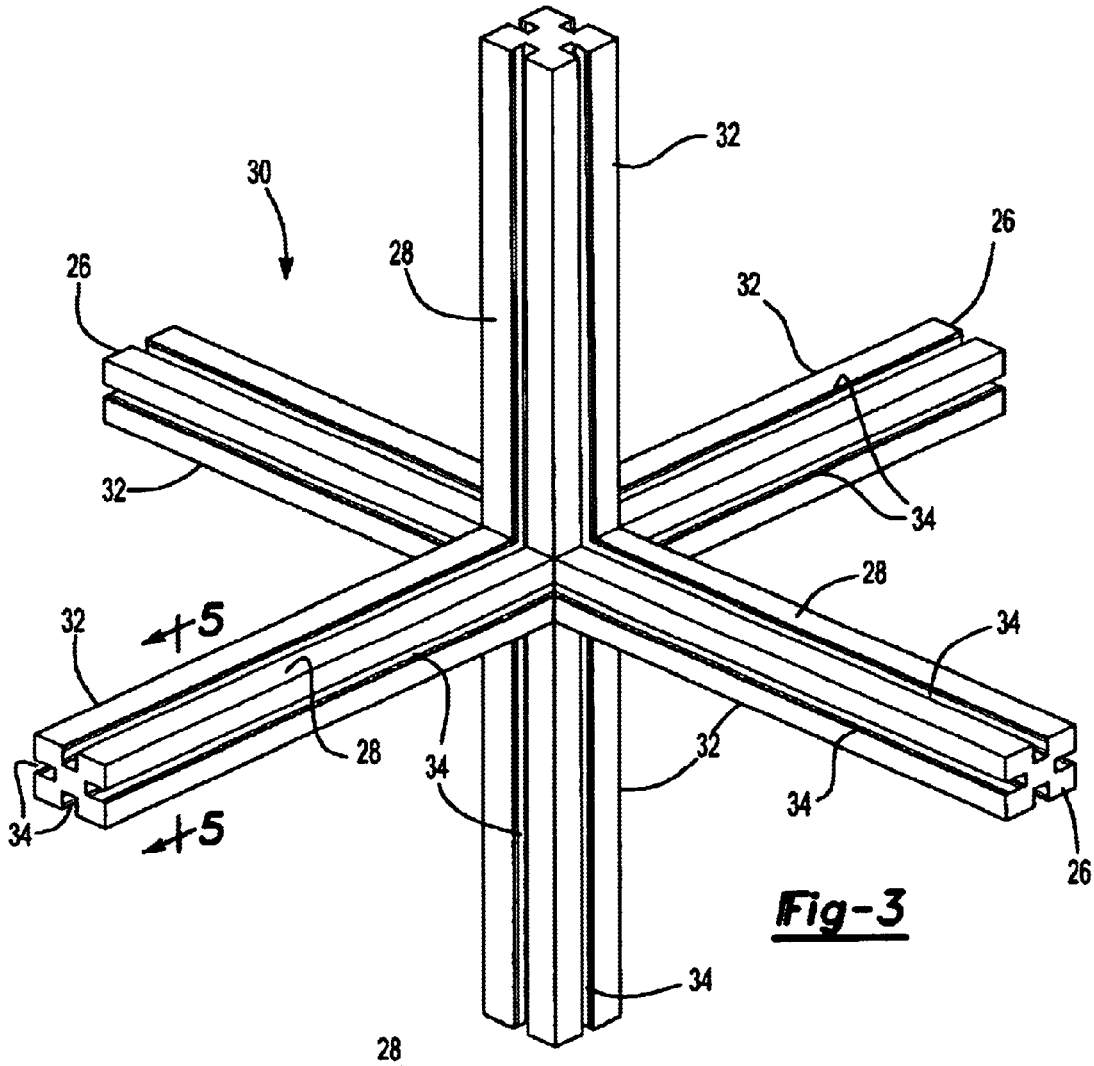
FIG. 3 is a perspective view of a portion of the preferred embodiment of the present invention.
Figure 4:
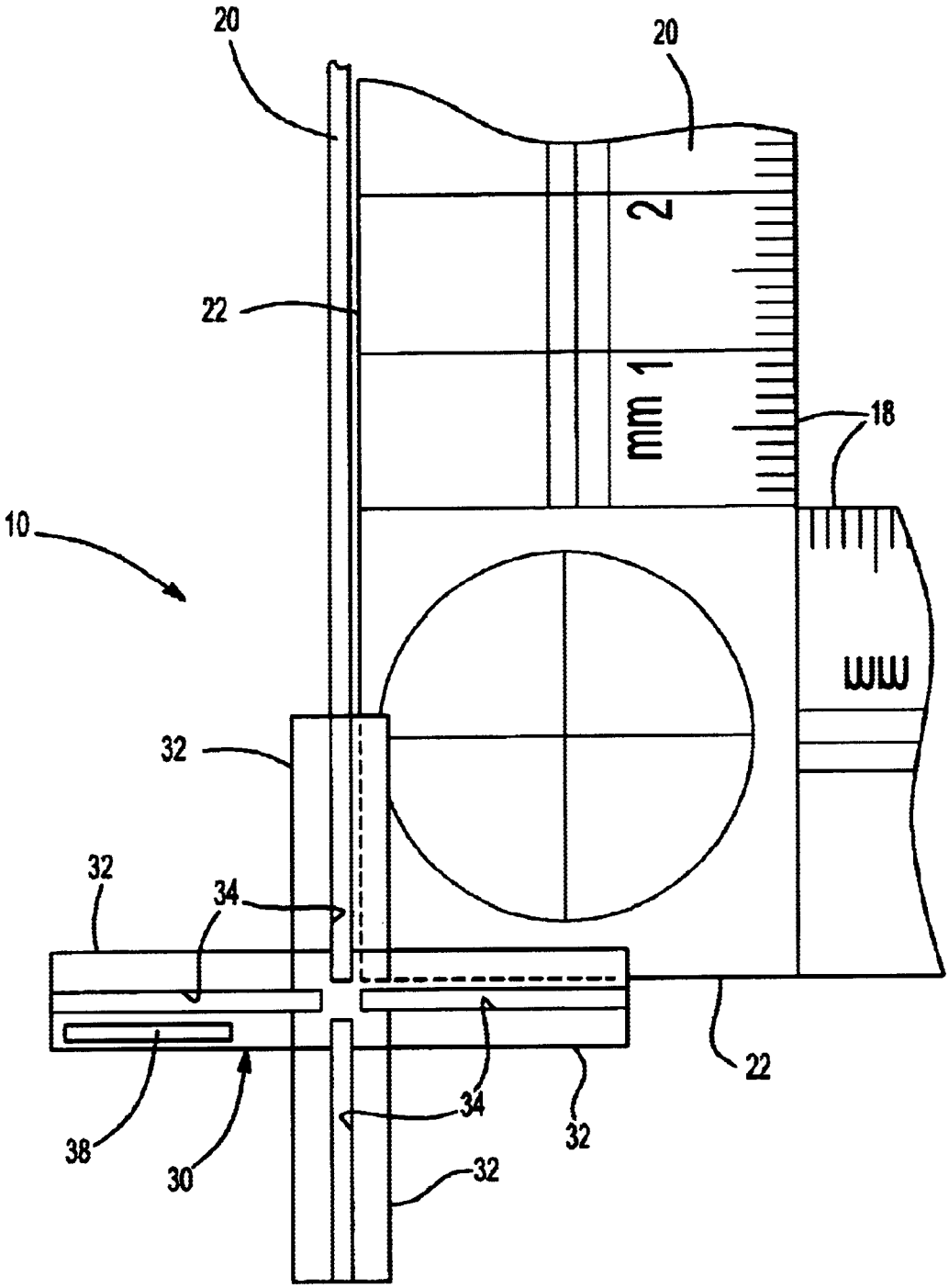
FIG. 4 is an end view of the portion of the preferred embodiment of the present invention shown in FIG. 3.

The evidence marker 10 of the present invention also comprises a substantially rigid leg unit 30 connecting the at least two flat marker elements 20 at an angle with respect to one another, preferably at a right angle with respect to one another. As shown in FIGS. 3 and 4, the leg unit 30 consists of six orthogonally disposed legs 32, each of the legs 32 including at least one groove 34 for receiving one of the outer edges 22 of one of the flat marker elements 20. Preferably, each of the six legs 32 of the leg unit 30 is the same length, square in cross-section, and has four orthogonal grooves 34 formed longitudinally therein.

Figure 5:
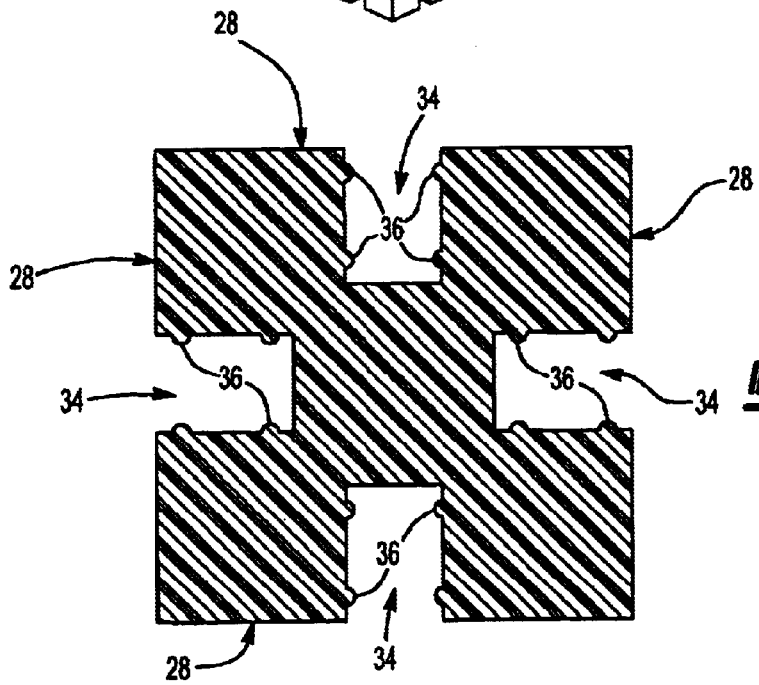
FIG. 5 is a cross-sectional view taken along line 5—5 of FIG. 3.

The leg unit 30 is preferably composed of a material which permits the flat marker elements 20 to be retained in the grooves 34 by friction, preferably reversibly retained by friction such that the leg unit 30 detachably secures the at least two flat marker elements 20 to one another. The leg unit 30 can comprise a synthetic, plastic, polymeric, metal or rubber material suitable to this purpose. As shown in FIG. 5, each of the six legs 32 can include one or more projections 36 extending into its at least one groove 34 to retain or assist the retention of the flat marker elements 20 in the grooves 34, and in particular, to retain or assist the retention of the outer edge 22 of one of the flat marker elements 20 therein.

Certain dimensions for the leg unit 30 and its six legs 32 may be especially preferred when the at least two flat marker elements 20 are ABFO No. 2 Scales. More particularly, the grooves 34 of the legs 32 are preferably about 1 mm wide, closely dimensioned to retain one of the flat marker elements 20 therein by friction. Each of the grooves 34 of the six legs 32 of the leg unit 30 is preferably about 5 mm deep, measured from the surface 28 of each leg 32. Each of the six legs 32 of the leg unit 30 is preferebly about 1 to about 3 cm lon,. more preferably about 2 cm long, measured from the surfaces 28 of the adjacent legs 32. Each of the six legs 32 of the leg unit 30 is preferebly square in cross-section and about 1.5 cm thick.

In use, when the evidence marker 10 of the present invention includes three of the flat marker elements 20, the evidence marker 10 may be positioned such that the evidence marker 10 rests on the tips 24 of two of the flat marker elements 20. The evidence marker 10 may instead be positioned such that the tip or tips 24 of one or more of the flat marker elements 20 rests on a non-planar item 12 of evidence, or positioned such that the interior edge or edges 18 of one or more of the flat marker elements 20 rests on a non-planar item 12 of evidence. Moreover, while it may not be preferred, it is contemplated that the relative weights of the flat marker elements 20 and the leg unit 30 are such that the evidence marker 10 may be positioned on a surface without any of the tips 24 of the flat marker elements 20 contacting that surface; that is, such that the leg unit 30 is capable of resting on the tips 26 of three of the six legs 32 of the leg unit 30 while two of the flat marker elements 20 are connected by the other three of the six legs 32 of the leg unit 30.

The evidence marker 10 of the present invention may of course comprise flat marker elements 20 other than the ABFO No. 2 Scale. Such other flat marker elements need not be L-shaped, but merely need possess a perpendicular pair of edges, at least one of which can be received in the grooves 34 of the orthogonal legs 32 of the leg unit 30.

It is convenient for the substantially rigid leg unit 30 of the evidence marker 10 of the present invention to further comprise an identifier 38 which enables the identification of any specific evidence marker 10 employed at a crime scene. The identifier 38 can be a simple numeric, alphabetic or alphanumeric symbol or combination of symbols positioned on the surface 28 of any one of the six legs 32 of the leg unit 30. Alternatively, the identifier 38 can be an optical bar code, similarly positioned, which is capable of being scanned by laser (not shown). It is believed that technology is or will soon be available which would allow the information so scanned to be read directly into, and stored within, a hand-held computing device (also not shown), and such information correlated with a GPS (global positioning system) function included in the computing device. It is also believed that continuing miniaturization of electronic circuitry may in the near future permit a GPS function to be placed on or in the substantially rigid leg unit 30 as the identifier 38. In either case, the photographic memorial provided by the evidence marker 10 of the present invention could then be positively associated with a specific and closely determined geographic location.

Use of the evidence marker 10 of the present invention is straight-forward. If not permanently attached, the outer edges 22 of two or more flat marker elements 20 are first inserted into selected grooves 34 of the legs 32 of the leg unit 30. The assembled evidence marker 10 is then positioned with respect to an item 12 of evidence as desired, and the item 12 of evidence photographed with the evidence marker in the field of view.

It is believed that the evidence marker 10 of the present invention possesses significant advantages over prior evidence markers. By displaying two or more scale markings or other indicia at a known angle but in different planes, a unique photographic angle or direction of view is more readily established than with prior evidence markers. Part of the evidence marker 10 can be overlapped by a non-planar item of evidence, permitting the size of the item of evidence to be more reliably established than with prior evidence markers. The evidence marker 10 is relatively simple and inexpensive in construction, yet adequately maintains the flat marker elements 20 in a substantially rigid relationship while permitting the marker 10 itself to be collapsed to a smaller size for storage, upon detaching the flat marker elements 20 from the leg unit 30.

The details of the construction or composition of the various elements of the evidence marker 10 of the present invention not otherwise disclosed are not believed to be critical to the achievement of the advantages of the present invention, so long as the elements possess the strength or mechanical properties needed for them to perform as disclosed. The selection of any such details of construction are believed to be well within the ability of one of even rudimentary skills in this area, in view of the present disclosure.

It is to be understood, however, that the above-described evidence marker is merely an illustrative embodiment of the principles of this invention, and that other devices and methods for using them may be devised by those skilled in the art, without departing from the spirit and scope of the invention. It is also to be understood that the invention is directed to embodiments both comprising and consisting of the disclosed parts, except that the leg unit 30 consists of six of the legs 32.

What is claimed is:

1. An evidence marker comprising:

at least two flat marker elements bearing visual indicia thereon, each of the flat marker elements having a pair of perpendicular outer edges; and a substantially rigid leg unit connecting the at least two flat marker elements at an angle with respect to one another;

wherein said leg unit consists of six orthogonally disposed legs, each of the legs including at least one groove for receiving an edge of one of the flat marker elements therein; and wherein each of the six legs of the leg unit is substantially shorter than each of the pair of outer edges of the flat marker elements.

2. The evidence marker according to claim 1, wherein each of the six legs of the leg unit is the same length.

3. The evidence marker according to claim 1, wherein each of the six legs of the leg unit has four orthogonal grooves formed longitudinally therein.

4. The evidence marker according to claim 1, wherein the leg unit comprises a plastic or polymeric material.

5. The evidence marker according to claim 1, wherein each of the six legs of the leg unit is square in cross-section.

6. The evidence marker according to claim 1, wherein the at least two flat marker elements are L-shaped and symmetrical, the pair of perpendicular edges being outer edges of the flat marker elements.

7. The evidence marker according to claim 6, wherein each of the pair of perpendicular outer edges of the flat marker elements is about 10 to 11 cm long.

8. The evidence marker according to claim 7, wherein each of the flat marker elements are about 1 mm thick; and wherein each of the grooves in the six legs of the leg unit is about 1 mm wide, dimensioned to retain one of the flat marker elements therein by friction.

9. The evidence marker according to claim 1, wherein the leg unit detachably secures the at least two flat marker elements to one another.

10. The evidence marker according to claim 1, wherein each of the grooves of the six legs of the leg unit is about 5 mm deep.

11. The evidence marker according to claim 1, wherein each of the six legs of the leg unit is about 1 to 3 cm long.

12. The evidence marker according to claim 11, wherein each of the six legs of the leg unit is about 2 cm long.

13. The evidence marker according to claim 1, wherein each of the six legs of the leg unit is square in cross-section and about 1.5 cm thick.

14. The evidence marker according to claim 1, wherein the at least two flat marker elements comprise three flat marker elements.

15. The evidence marker according to claim 1, wherein each of the six legs of the leg unit includes a tip, and wherein the relative weights of the flat marker elements and the leg unit are such that the leg unit is capable of resting on the tips of three of the six legs of the leg unit while two flat marker elements are connected by the other three of the six legs of the leg unit.

16. The evidence marker according to claim 1, wherein each of the six legs includes at least one projection extending into its at least one groove for retaining one of the flat marker elements therein.

17. The evidence marker according to claim 1, wherein the leg unit connects the at least two flat marker elements at a right angle with respect to one other.

18. The evidence marker according to claim 1, wherein the leg unit comprises an identifier.

19. An evidence marker comprising:

at least two identical flat marker elements bearing visual indicia thereon, each of the flat marker elements being L-shaped and symmetrical, and each being about 1 mm thick and having a pair of perpendicular outer edges about 10 to 11 cm long; and a substantially rigid leg unit connecting and detachably securing the at least two flat marker elements at a right angle with respect to one another, the leg unit comprising a plastic or polymeric material;

wherein said leg unit consists of six identical, orthogonally disposed legs each about 1 to 3 cm long;

wherein each of the six legs of the leg unit is substantially shorter than each of the pair of outer edges of the flat marker elements, are of the same length, are square in cross section and are about 1.5 cm thick;

wherein each of the six legs of the leg unit has four orthogonal grooves about 1 mm wide and about 5 mm deep formed longitudinally therein, dimensioned to retain one of the flat marker elements therein by friction.

* * * * *